US005961744A

United States Patent [19]

Yamazaki et al.

[11] Patent Number: 5,961,744

[45] Date of Patent: Oct. 5, 1999

[54] GRAIN ORIENTED SILICON STEEL SHEET HAVING LOW CORE LOSS AND METHOD OF MANUFACTURING SAME

[75] Inventors: Shuichi Yamazaki; Hiroyasu Fujii; Takeo Nagashima; Yoshiyuki Ushigami, all of Futtsu; Osamu Tanaka, Kitakyushu; Katsurou Kuroki, Kitakyushu; Hiroaki Masui, Kitakyushu, all of Japan

[73] Assignee: Nippon Steel Corporation, Tokyo, Japan

[21] Appl. No.: 08/449,185

[22] Filed: May 24, 1995

Related U.S. Application Data

[63] Continuation of application No. 08/043,244, Apr. 6, 1993, abandoned.

[30] Foreign Application Priority Data

| | | | |
|---|---|---|---|
| Apr. 7, 1992 | [JP] | Japan | 4-085501 |
| May 8, 1992 | [JP] | Japan | 4-116451 |
| Aug. 25, 1992 | [JP] | Japan | 4-226167 |

[51] Int. Cl.[6] ..... C21D 8/12

[52] U.S. Cl. ..... 148/113; 148/111

[58] Field of Search ..... 148/111, 112, 148/113, 307, 308

[56] References Cited

U.S. PATENT DOCUMENTS

| | | | |
|---|---|---|---|
| 4,255,205 | 3/1981 | Morito et al. | 148/113 |
| 4,875,947 | 10/1989 | Nakayama et al. | 148/113 |
| 4,909,864 | 3/1990 | Inokuti et al. | 138/113 |

FOREIGN PATENT DOCUMENTS

| | | | |
|---|---|---|---|
| 48-39338 | 6/1973 | Japan . | |
| 49-96920 | 9/1974 | Japan . | |
| 59-104431 | 6/1984 | Japan . | |
| 60-13195 | 6/1985 | Japan . | |
| 60-131976 | 7/1985 | Japan . | |
| 61-11721 | 4/1986 | Japan . | |
| 62-253579 | 11/1987 | Japan . | |
| 2-107784 | 4/1990 | Japan | 148/113 |
| 4-131326 | 5/1992 | Japan . | |

OTHER PUBLICATIONS

Morito, N. and Ichida, T. "Transition from external to internal oxidation in iron–silicon alloy as a function of oxygen potential of the ambient atmoshere," Scripta Metallurgica, vol. 10, pp. 619–622, 1976.

*Primary Examiner*—Sikyin Ip
*Attorney, Agent, or Firm*—Kenyon & Kenyon

[57] ABSTRACT

Grain oriented silicon steel sheet on which is formed an insulating coating having a thickness that is not less than 2.5 μm that imparts tension to the steel sheet which does not have an inorganic mineral layer formed during a final annealing step (glass film) and a method of forming on grain oriented silicon steel sheet an insulating coating that is not less than 2.5 μm thick and which imparts tension to the steel sheet which does not have the inorganic mineral layer (glass film) that forms during finish annealing, and a method of forming a tensioning insulating coating on grain oriented silicon steel sheet which has been finish annealed and does not have an inorganic mineral surface layer (glass film), after first forming a layer of $SiO_2$ not less than 0.001 μm thick on the oriented silicon steel sheet.

10 Claims, 10 Drawing Sheets

CONDITION 1

CONDITION 2

10μm

× 10000

GRAIN ORIENTED SILICON STEEL SHEET HAVING LOW CORE LOSS AND METHOD OF MANUFACTURING SAME

This application is a continuation of application Ser. No. 08/043,244 filed Apr. 6, 1993, now abandoned.

BACKGROUND OF THE INVENTION

1. Field of the Invention

The present invention relates to oriented grain silicon steel that has very low core loss, and to a method of manufacturing same.

2. Description of the Prior Art

Grain oriented electrical steel sheet is extensively used as a material for magnetic cores. There is a particular demand for low core loss steel in order to reduce energy loss. An effective way of reducing core loss is to impart tension to steel sheet. The Tension can be effectively imparted to steel sheet by high temperature formation of a coating constituted by a material that has a smaller coefficient of thermal expansion than that of the steel sheet. During the finish annealing step, a layer in which the main component is forsterite is formed by reaction of surface oxides on the steel with the annealing separator. This coating gives a high degree of tension to the steel sheet and is effective for reducing core loss.

A highly effective method of imparting tension to steel sheet and thereby reducing the core loss is the method disclosed by JP-A-48-39338, whereby an insulating coating is formed by baking on a coating liquid in which the main components are a colloidal silica and aluminum phosphate. Therefore forming an insulating coating that imparts tension, after retaining the film formed in the finish annealing process, has become the normal method of producing grain oriented electrical steel sheet.

On the other hand, recently it has become clear that disordered interface structure between the forsterite-based layer and the base metal reduces the tension effect on core loss. Thus, JP-A-49-96920 and JP-A-04-131326, for example, disclose a process for reducing core loss by removing the forsterite layer formed by the finish annealing process and giving the steel surface a mirror finish before applying a tension coating.

When the forsterite layer is removed, or when the formation of such a layer is intentionally avoided, it becomes necessary to ensure the requisite tension with just the insulating layer. Thus, the insulating layer has to be made thick enough for this purpose, but the prior art does not clarify just what the necessary thickness is. In addition, a coating liquid that is applied over a film that is mainly constituted of forsterite has quite good adhesion. But when the forsterite layer is removed or when the formation thereof is intentionally avoided in the finish annealing, the coating has insufficient adhesion. Therefore it is necessary to improve the adhesion of the insulating coating to the steel sheet. For the above reasons, the effect of the mirror surface finishing according to the prior art was not enough to provide a sufficient reduction in core loss properties.

JP-A-60-131976 discloses forming method of insulating coating on the mirror finished steel sheet. Namely, by annealing steel sheet in a relatively weak oxidizing atmosphere in order to form a $SiO_2$ oxide layer that is about 0.05 to 0.5 $\mu$m thick, and then forming the insulating coating. According to the disclosure, the $SiO_2$ oxide layer is comprised of $SiO_2$ precipitates dispersed in the steel. However, as described below, an insulating coating has poor adhesion when the oxide layer is comprised by the dispersed $SiO_2$ precipitates in the steel, a so-called internal oxide layer. As such, defining the $SiO_2$ content may not be enough to achieve a coating having good adhesion.

SUMMARY OF THE INVENTION

The object of the present invention is therefore to provide grain oriented electrical steel sheet that has very low core loss, and a method of manufacturing the steel sheet.

DETAILED DESCRIPTION OF THE INVENTION

The present invention attempts to reduce core loss by forming an insulating coating more than 2.5 $\mu$m thick on oriented silicon steel sheet that has no forsterite film. A method is presented for enhancing the adhesion of an insulating coating to steel sheet having no forsterite layer. This method consists of (1) forming a thin film of $SiO_2$ on the surface of the steel sheet prior to applying the insulating coating, or pickling the steel in a diluted sulfuric acid solution to form small, sharply defined pits; and (2) adding hydrogen to the atmosphere in which the insulating coating is baked. This provides an insulating coating that has good adhesion and, for the reason, the thickness of the insulating coating can be increased by using two or more applications and bakings.

Figure 1:
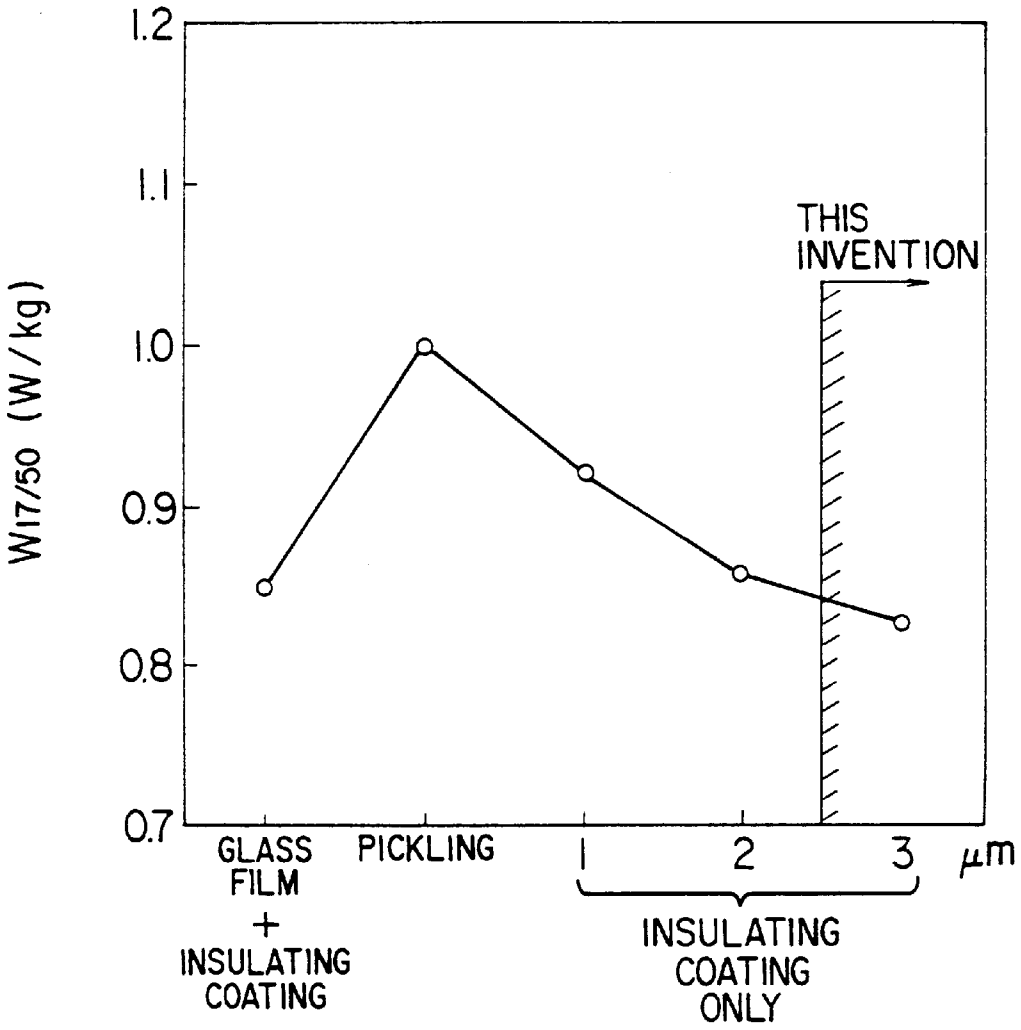
FIG. 1 is a graph that illustrates how the presence or absence of a glass film, and the thickness of the insulating coating, affects core loss values.

An investigation was made on the thickness of the insulating coating requisite to reduce core loss in grain oriented electrical steel sheet from which the forsterite layer has been removed or the formation of such a layer intentionally avoided. FIG. 1 shows a comparison between core loss values of normal oriented silicon steel sheet on which a tensioning insulating coating has been applied over a forsterite layer, and grain oriented silicon steel sheet that has only a tensioning insulating coating. Namely, change of core loss in following successive treatments, was studied for grain oriented silicon steel sheet ($B_8$=1.93, 0.33 mm thick) that has a forsterite layer (glass film) and an insulating coating (2 $\mu$m thick). 1 Magnetic domains were refined by forming grooves mechanically using the method disclosed in JP-A-61-117218. 2 The glass film and the insulating coating were removed by pickling (preserving the magnetic domain refining effect). 3 Application and baking of an insulating coating composed of chromic anhydride, colloidal silica and aluminum phosphate was repeated. It was found that while core loss became worse when coating was removed by pickling, increasing the thickness of the insulating coating produced a corresponding decrease in core loss, and with an insulating coating thickness more than 2.5 $\mu$m the core loss became lower than that of normal steel. With respect to the baking process applied to the insulating coating, the measures described below were used to improve adhesion.

As measures for improving the adhesion of the insulating coating, the inventors studied one method involving pretreating the steel before applying the coating, and another method involving controlling the conditions used to bake the coating liquid. In the case of the former method, forming a thin film of $SiO_2$ on the surface of the steel sheet prior to applying the insulating coating, or pickling the steel in a diluted sulfuric acid solution to form small, sharply defined pits, is effective. In the case of the latter method, adding hydrogen to the baking atmosphere is effective, particularly when colloidal silica and aluminum phosphate are the main components of the coating liquid. When pretreatment measures are combined with baking process measures, it becomes possible to achieve a marked improvement in insulating coating adhesion, and to increase the thickness of the coating by multiple applications and bakings of the coating liquid.

It was considered that even in the case of steel sheet in which, forsterite or other such inorganic mineral layer were removed and the base metal was exposed, high coating adhesion could be ensured if a layer which has good adhesion to both the insulating coating and steel was formed before insulating coat. Based on numerous studies carried out to investigate this idea, it was confirmed that forming a thin film of $SiO_2$ on the surface of the steel sheet improved the adhesion of the insulating coating. The present invention was also accomplished with the new discovery that this $SiO_2$ layer has to be external oxidation structure, and has absolutely no effect if it is internal oxidation structure. Here, external oxidation layer refers to an oxidation layer formed under low oxygen partial pressure by diffusion and oxidation of alloy element (silicon) at the surface layer of the steel sheet. In the case of external oxidation, oxide layer has film like structure. An internal oxidation layer refers to an oxidation layer formed under a relatively high oxygen partial pressure in which the alloy element is oxidized with virtually no diffusion, forming alloy element oxides ($SiO_2$) which disperse in the form of a precipite near the surface layer of the steel sheet.

Specific details of the results of the investigations will now be described. In accordance with the method described by JP-A-4-131326. Pickling was used to remove a glass film formed on oriented silicon steel sheet containing 3 percent silicon. The steel sheet was then subjected to an extended period of high temperature annealing in a reducing atmosphere (hereinafter referred to as "pickling-flattening annealing"), using as a spacer material silicon steel sheet having glass film. As a result, steel sheets having a mirror finish and no glass film were obtained. This steel sheets were then annealed at 750° C. for 200 seconds under the condition $P_{H2O}/P_{H2}$ of 0.02 (Conditions 1) and at 750° C. for 150 seconds and under the condition $P_{H2O}/P_{H2}$ of 0.15 (Conditions 2). To examine the amount of $SiO_2$ that was formed above treatments, the residue obtained by potentiostatic extraction in non-aqueous electrolyte (only oxides recoverable) was analyzed by ICP method (Table 1). The liquid constituted of colloidal silica, aluminum phosphate and dichromate disclosed by JP-A-48-39338 was applied to each of the steel sheets and baked in a nitrogen atmosphere at 800° C. Steel sheet annealed using Conditions 1 had a coating with good properties that showed no peeling at a bending-test curvature of 10 mm. On the other hand, the coating that had been baked on using Conditions 2 peeled off.

Figure 2A:
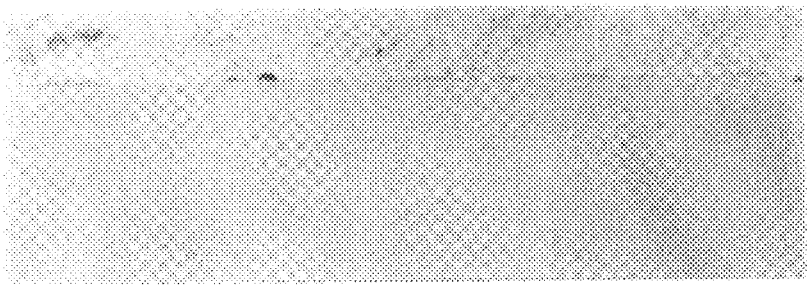
FIG. 2 shows optical micrographs of structural differences in the oxide layer produced by annealing silicon steel sheet under different oxigen chemical potential conditions.
Figure 2B:
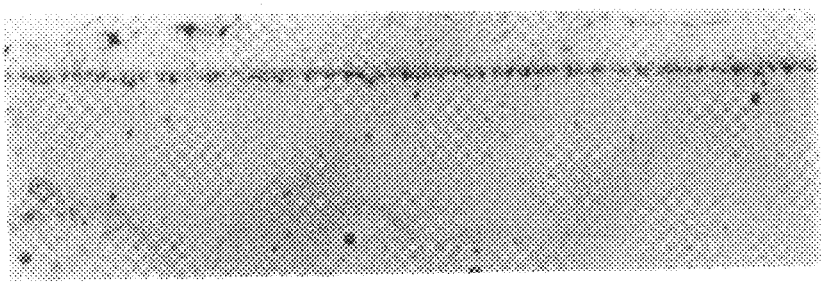

It can be seen that the reason for the poor quality of the coating formed under Conditions 2, despite the fact that more $SiO_2$ was formed by this method, is in the structure of the oxide layer (FIG. 2). While Conditions 1 only produced an external oxidation layer of $SiO_2$ (having an estimated thickness of not more than 0.01 $\mu$m), in the case of Conditions 2 there was marked internal oxidation.

TABLE 1

| Condition | Annealing conditions $P_{H_2O}/P_{H_2}$ | Temperature (° C.) | Time (sec) | Amount of $SiO_2$ ($g/m^2$/on side surface) | Adhesion of insulating coating |
|---|---|---|---|---|---|
| 1 | 0.02 | 750 | 200 | 0.015 | Good adhesion |
| 2 | 0.15 | 750 | 150 | 0.13 | Peeling |

Figure 3:
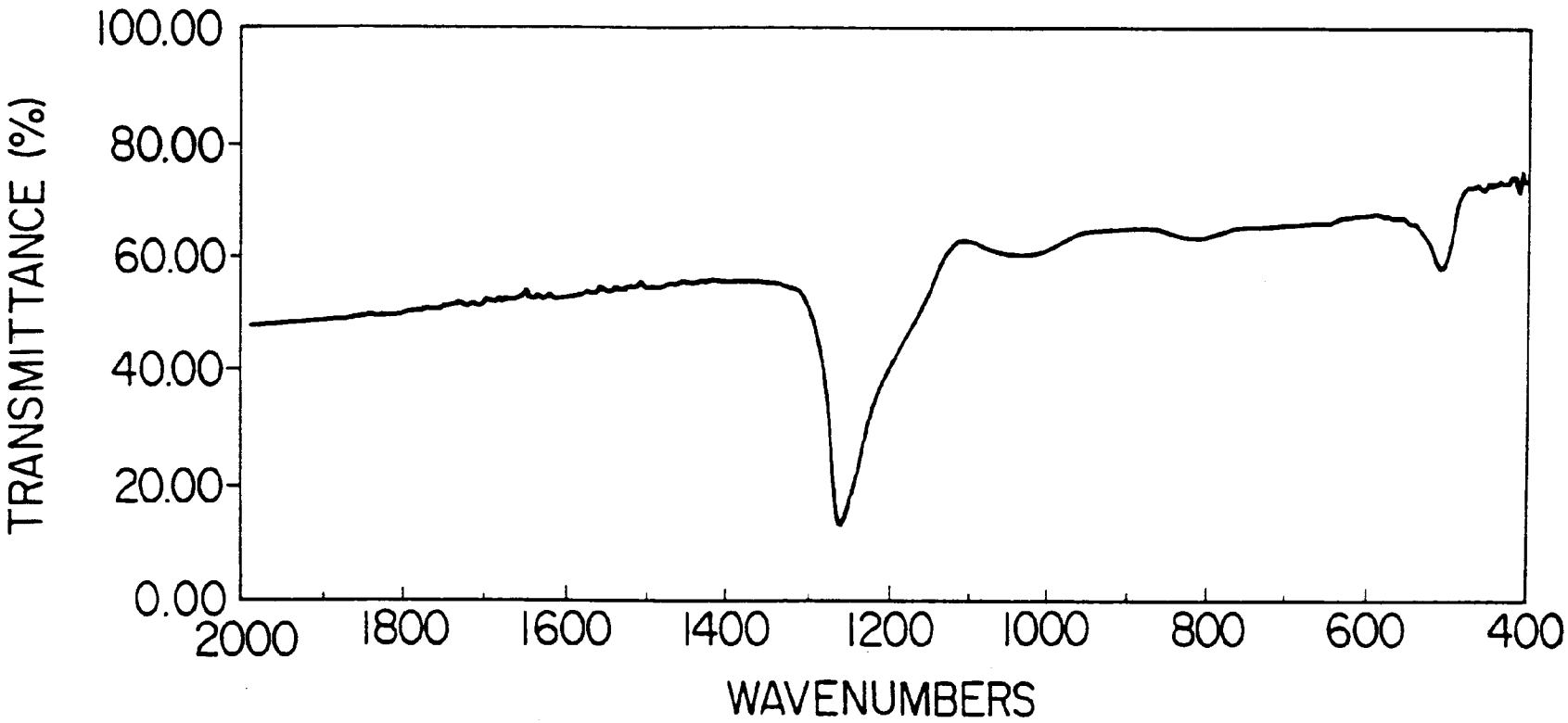
FIG. 3 is an infrared reflection absorption spectrogram of a thin external oxidation layer of $SiO_2$ formed by annealing silicon steel sheet in a weak oxidizing atmosphere.

By the same test conducted under various annealing conditions, it was confirmed that the formation of the insulating coating was always obstructed or the coating had insufficient adhesion when internal oxidation was produced by annealing. As can be seen from Table 1, if the $SiO_2$ layer has external oxidation structure, even when the amount is very small (<0.01 $\mu$m), the insulating coating has sufficient adhesion. Because it is difficult to evaluate the amount of $SiO_2$ in this kind of very thin external oxidation layer by the above electrolyte residue ICP analysis procedure, it is preferable to use infrared reflection absorption spectroscopy (cf. Suetaka, Bunko Kenkyu, vol. 26, page 251 (1977)). The fact that this method provides information on just the external oxidation while not detecting internally precipitated oxides makes it a suitable way of evaluating the present invention. FIG. 3 is an infrared reflection absorption spectrum of an external oxidation layer of $SiO_2$ formed by annealing under Conditions 1.

From Table 2 it can be understood that formation of an external oxidation layer of $SiO_2$ does not degrade the magnetic properties of grain oriented silicon steel sheet. Table 2 shows the results of an examination of differences in core loss values before and after annealing under conditions to produce external oxidation layer of $SiO_2$ on commercial grain oriented silicon steel sheets (0.23 mm thick) which were mirror-finished by the pickling-flattening annealing process described above.

TABLE 2

| Sample No. | Amount of $SiO_2$ g/m²/on side surface | Amount of $SiO_2$ μm/on side surface | Difference in core loss values before and after annealing $W_{17/50}$/W.kg$^{-1}$ |
|---|---|---|---|
| 1 | 0.02 | 0.01 | −0.01 |
| 2 | 0.04 | 0.02 | +0.02 |
| 3 | 0.05 | 0.02 | +0.01 |
| 4 | 0.07 | 0.03 | −0.00 |
| 5 | 0.11 | 0.05 | −0.01 |

Figure 4:
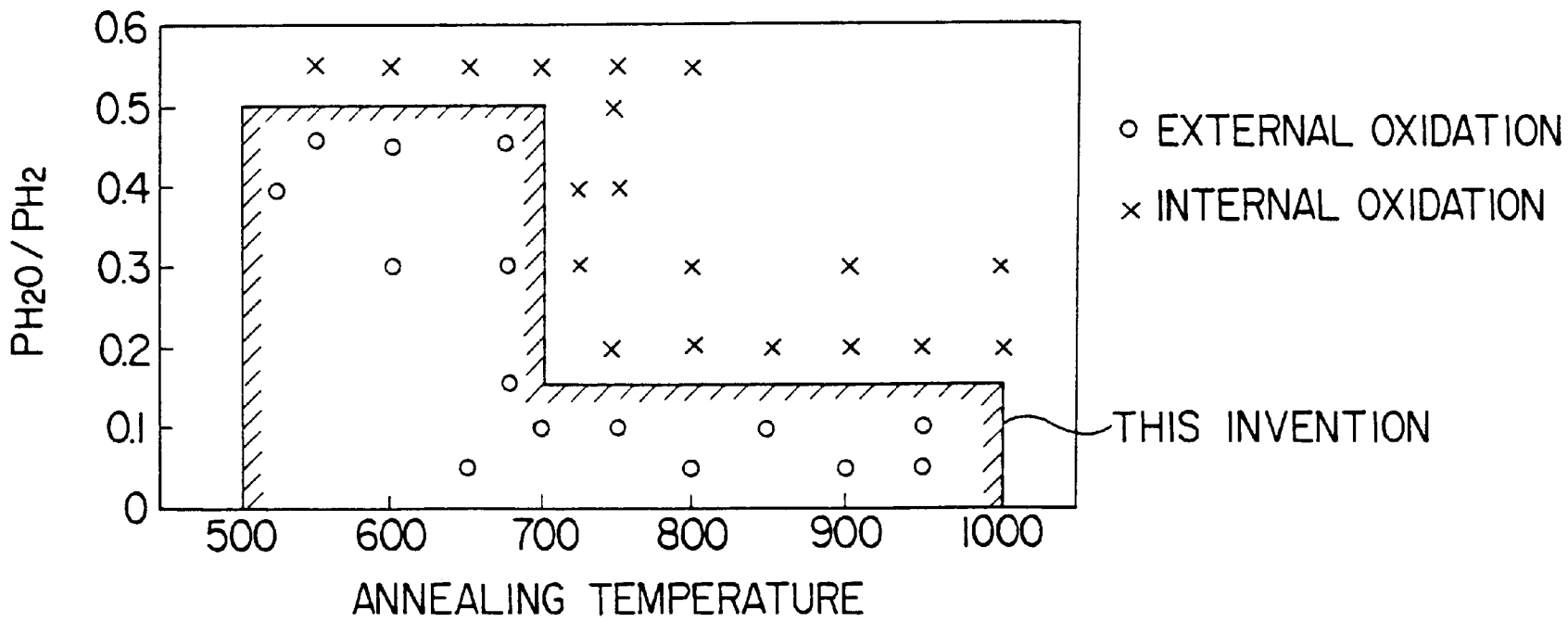
FIG. 4 is a chart that illustrates the relationship between silicon steel sheet annealing conditions and oxide layer structure.

The annealing conditions for ensuring the adhesion of the insulating coating, that is, the annealing conditions that will produce only external oxidation layer of $SiO_2$, can be set according to FIG. 4. FIG. 4 depicts the observed oxidation layers formed on steel sheet with a silicon content of 2 to 4.8 percent under the different annealing conditions and temperatures. With reference to FIG. 4, the insulating coating formed on each of the steel sheets on which only external oxidation layer of $SiO_2$ had been formed exhibited good properties and sufficient adhesion. According to FIG. 4, an insulating coating having good tensioning properties can be formed with good adhesion if annealing is carried under following conditions, at an annealing temperature of up to 700° C., $P_{H2O}/P_{H2} \leqq 0.5$, and at a temperature of not less than 700° C. and $P_{H2O}/P_{H2} \leqq 0.15$ The reason for defining an annealing temperature range of 500° C. to 1000° C. will now be described. Productivity is poor at a temperature below 500° C. even when a relatively high oxygen potential is used, owing to the long annealing time to form the $SiO_2$ oxidation layer at such a temperature. On the other hand, annealing over 1000° C. causes a softening of steel sheet and makes continuous annealing difficult, and also increase costs. At this point, no upper limit for the thickness of the external oxidation $SiO_2$ layer has been found. As long as there is no internal oxidation, increasing the thickness of the $SiO_2$ layer has not led to any observable degradation in the adhesion of the insulating coating or in the magnetic properties or other properties of the silicon steel sheet.

With reference to the method of forming a thin film of $SiO_2$ on the surface of steel sheet, while the above description refers only to annealing in a weakly oxidizing atmosphere, it is shown in the examples that good adhesion of insulating coating can also be given by forming $SiO_2$ films using chemical vapor deposition (CVD) or physical vapor deposition (PVD).

Figure 5A:
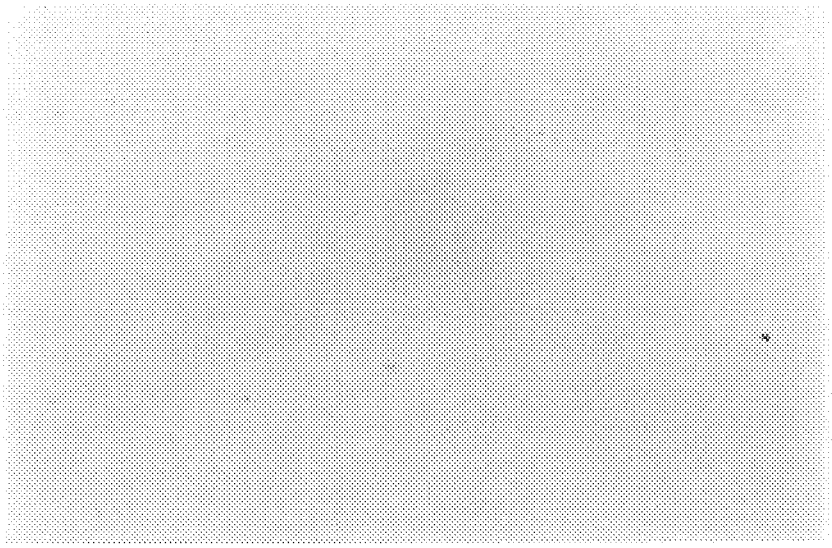
FIG. 5(*a*) and FIG. 5(*b*) show electron micrographs of steel sheet before and after immersion in dilute sulfuric acid, obtrained by the replica method.
Figure 5B:
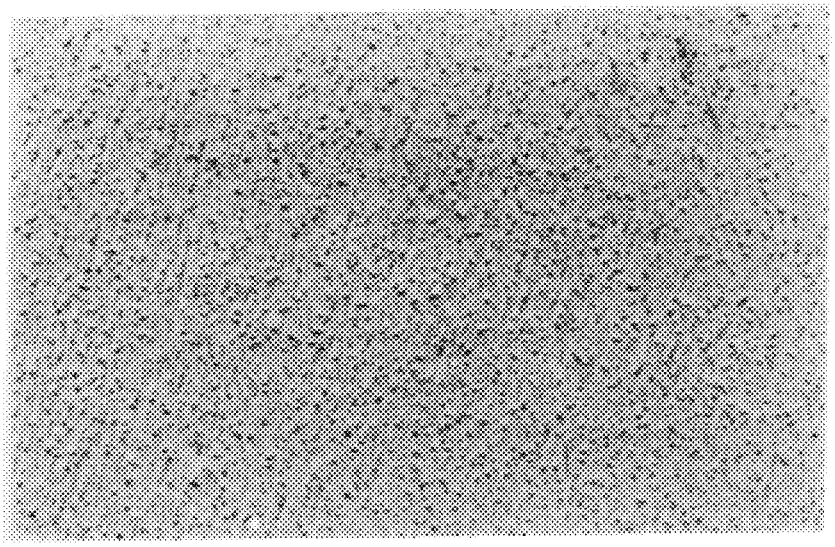

The results of studies on surface pretreatment by light pickling will now be described. FIG. 5(*a*) and FIG. 5(*b*) show electron micrographs, obtained by the replica method, of chemically polished steel sheet with average surface roughness of less than 0.1 μm (FIG. 5 (*a*)) and the steel sheet immersed for 60 seconds in a 5 percent sulfuric acid solution after chemical polishing (FIG. 5 (*b*)). It can be seen fine and sharp pits were formed by the immersion in the dilute sulfuric acid solution. These pits improve the wettability of the coating liquid with respect to the steel sheet, and the coating adhesion following baking. It is considered that these small pits do not act as obstacle to the movement of magnetic domain walls and that the pits therefore do not affect core loss values.

Figure 6:
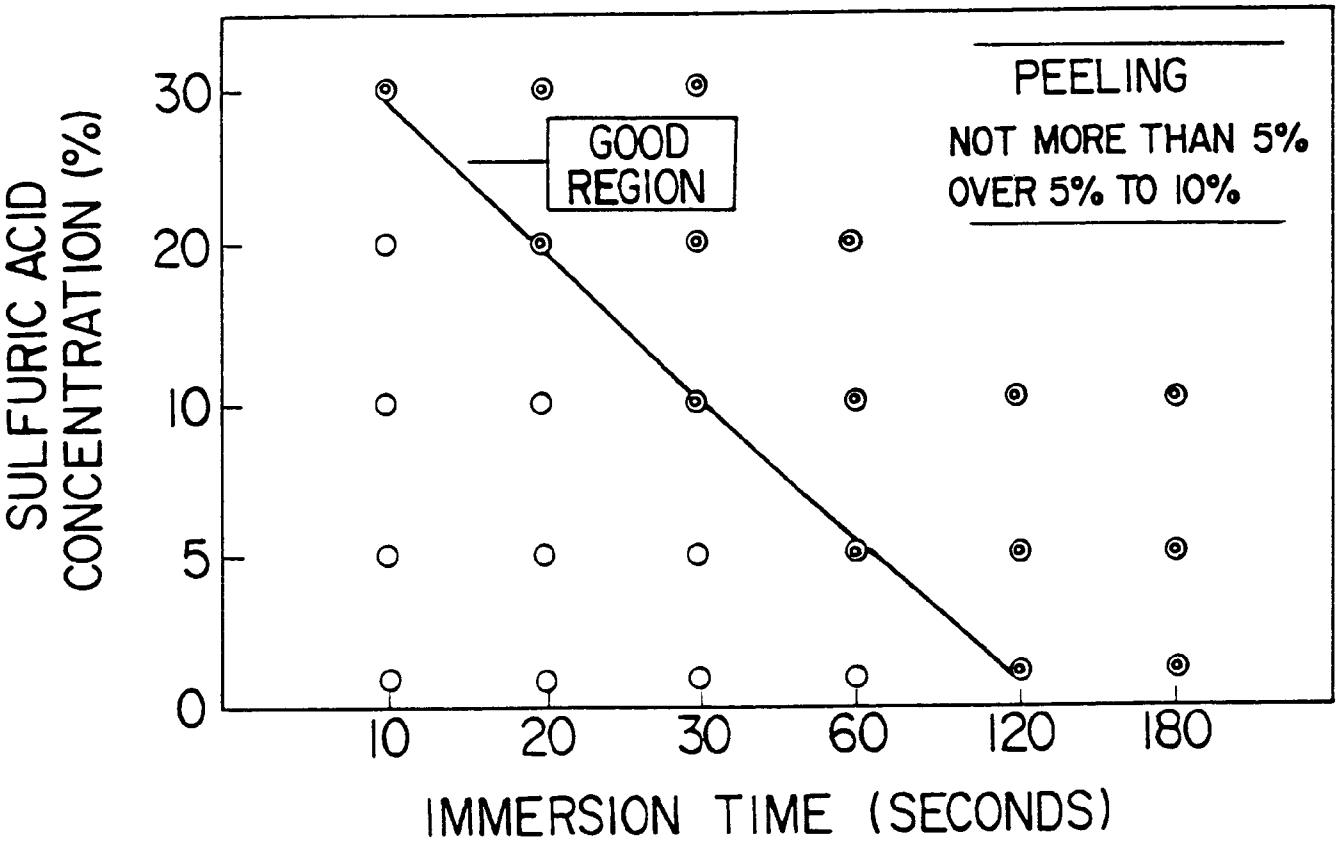
FIG. 6 is a graph showing the sulfuric acid immersion conditions that produce good coating adhesion properties.

The results of experiments confirming the adhesion of the insulating coating formed by this method will now be described. Pickling was used to remove the glass film formed on oriented silicon steel sheet by final annealing, and the sheet was then electrolytically polished to a mirror finish, immersed for 10 to 180 seconds in a 2 to 30 percent sulfuric acid solution, then washed and dried. The sheet was then coated with 3 g/m² per on one side of a coating liquid in which the main components were chromic anhydride, colloidal silica and aluminum phosphate, and baked in a nitrogen atmosphere at 820° C. The steel sheet thus obtained was then bent around a cylinder with a diameter of 20 mm to examine the adhesion of the coating. The results are shown in FIG. 6. Coating adhesion depends on the concentration of the sulfuric acid and on the length of the immersion period. In the case of 2 percent sulfuric acid an immersion period of not less than 120 seconds was required, while for 30 percent sulfuric acid the desired effect could be obtained with an immersion period of around 10 seconds. From the viewpoint of cost efficiency and the magnetic properties of the steel sheet, a surface pretreatment solution with a sulfuric acid concentration of 2 to 30 percent is appropriate. At a concentration below 2 percent the immersion period would be too long to be commercially feasible, while a concentration exceeding 30 percent would roughen the sheet surface and degrade core loss properties. While the length of the immersion period will vary according to the concentration of the solution and the temperature, in the case of the present invention, a period of 10 to 180 seconds is appropriate.

The findings relating to the baking atmosphere of coating liquid in which the main components are colloidal silica and phosphate will now be described. Grain oriented silicon steel sheets with silicon content of 3 percent and a thickness of 0.23 mm were picked to remove the glass film formed by the final annealing, producing a sheet thickness of 0.22 mm. The sheets were then coated with 4 g/m² of a coating liquid in which the main components were chromic anhydride, colloidal silica and aluminum phosphate, which was then baked for 30 seconds at 820° C. in a mixed gas atmosphere of hydrogen and nitrogen. To evaluate coating adhesion, the steel sheet thus obtained was subjected to a bending test using around a round bar with 20 mm in diameter and grading the adhesion according to the percentage of the coating that remained adhering to the sheet. The tension imparted to the sheet by the coating was calculated from the curvature of specimen sheet on which a coating was formed on one side only.

Figure 7:
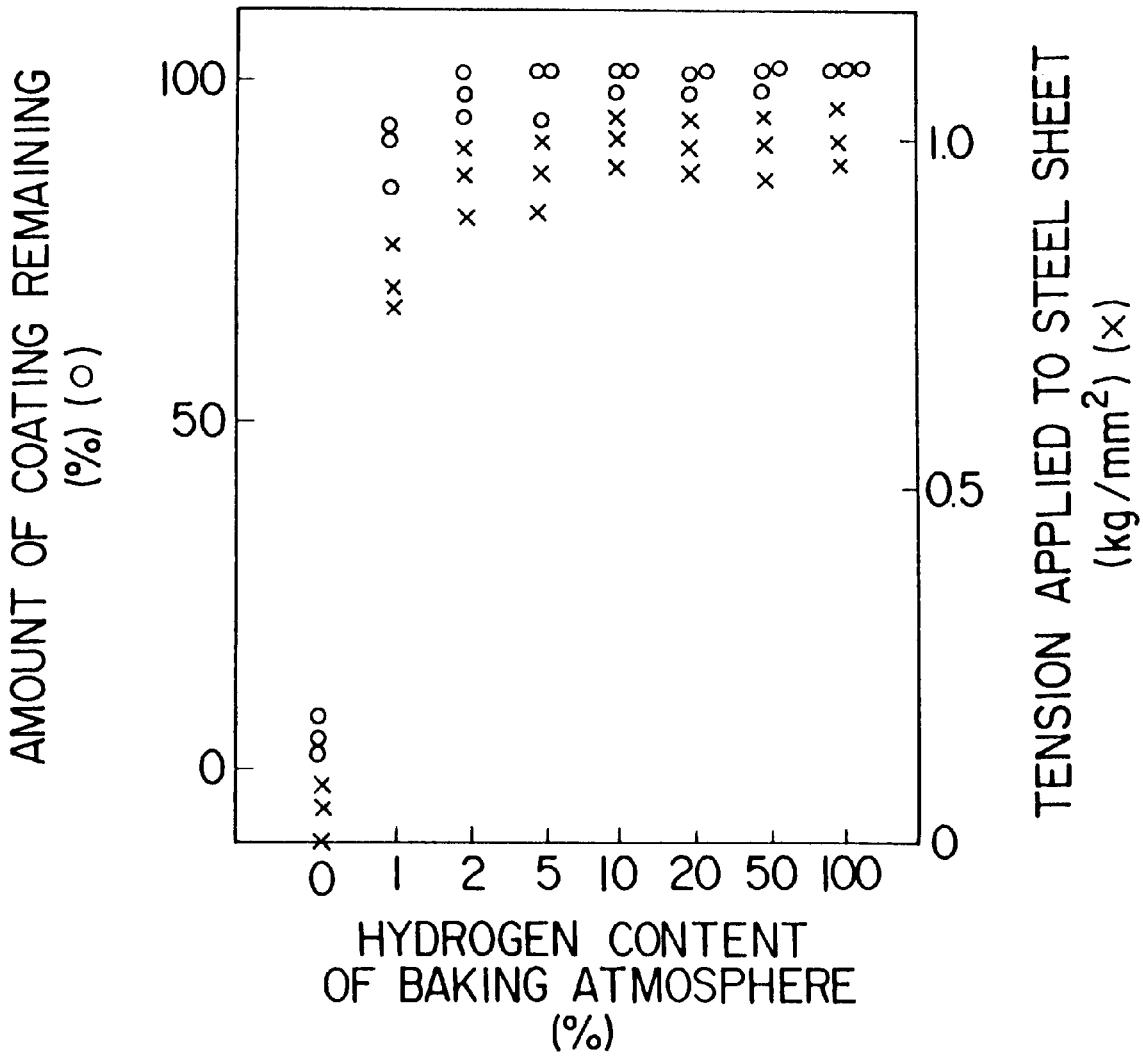
FIG. 7 is a chart depicting the relationship between coating adhesion properties and the hydrogen content of the tension coating baking atmosphere.

The results of the above tests are shown in FIG. 7. In FIG. 7, 0 indicates the percentage of the coating remaining, and X indicates the tension imparted to the steel sheet. From FIG. 7 it can be understood that coating adhesion can be improved by adding hydrogen to the baking atmosphere, and that a coating having good adhesion improves the tension.

JP-A-59-104431 discloses a method of baking an insulating coating in a weak reducing atmosphere containing 15 percent or less by volume of hydrogen, or hydrogen and carbon monoxide. However, this method is aimed at steel sheet that has the glass film. The inventions have different subjects. Moreover, the object of the prior art method is to prevent discoloration of the insulating coating and embrittlement of the steel sheet during insulating coating forming, whereas the aim of the present invention is to improve the adhesion of the coating, so the inventions also have different objects.

In the foregoing, two pretreatment processes and the baking atmosphere for coating have been described with reference to a method of improving the adhesion of an insulating coating. In this regard, the adhesion of the coating can be further improved by combining either pretreatment with optimization of baking atmosphere of insulating coating. For example, when only a pretreatment is applied, or when an insulating coating is formed in a hydrogen-containing atmosphere without any pretreatment, it is difficult to form a coating of 6 $g/m^2$ or more on one surface. On the other hand, using either of the pretreatment processes in combination with the baking method using hydrogen containing atmosphere enables to increase the coating amount by using a plurality of coating applications and bakings. Described below are the results of experiments confirming the effect on repeated coating applications and bakings.

Figure 8:
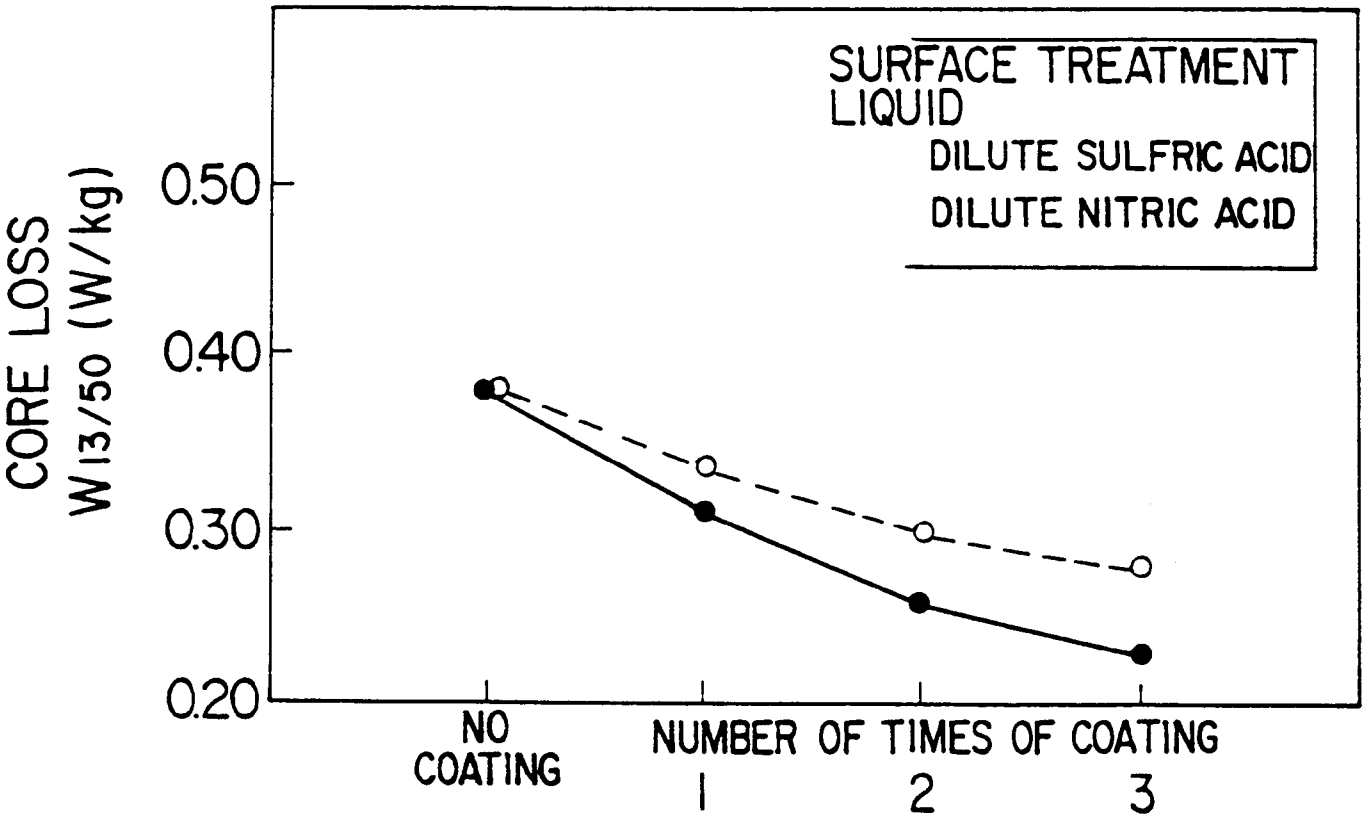
FIG. 8 is a graph showing the relationship between core loss and the number of times of coating.

In accordance with the method disclosed in JP-A-61-117218, a mechanical process was used to form grooves on grain oriented silicon steel sheets 0.15 mm thick having a silicon content of 3 percent and a magnetic flux density of $B_8$:1.94 T, to refine the magnetic domains of the steel sheet. The grooves were 13 $\mu$m deep and 50 $\mu$m wide, and were formed at an angle of 75 degrees to the rolling direction, at a 5 mm pitch; stress relief annealing at 800° C. for two hours was applied. Pickling was then used to remove the glass film and chemical polishing was applied to flatten the surface of the steel sheets. One of the steel sheets was then immersed for 30 seconds in a 10 percent solution of sulfuric acid. Another steel sheet was immersed for 30 seconds in a 10 percent solution of nitric acid, and both steel sheets were then washed and dried. The steel sheets were then coated with 3 $g/m^2$ of a coating liquid in which the main components were chromic anhydride, colloidal silica and aluminum phosphate. The coated steel sheets were dried, and then baked for 30 seconds at 820° C. in an atmosphere comprised of 20 percent hydrogen and 80 percent nitrogen. The application and baking of the coating liquid was then repeated and the magnetic properties measured. FIG. 8 shows the relationship between core loss and the number of coating applications. From FIG. 8 it can be seen that very low core loss values can be obtained by using multiple coatings. FIG. 8 also shows that dilute sulfuric acid treatment resulted in lower core loss values than dilute nitric acid treatment.

Figure 9:
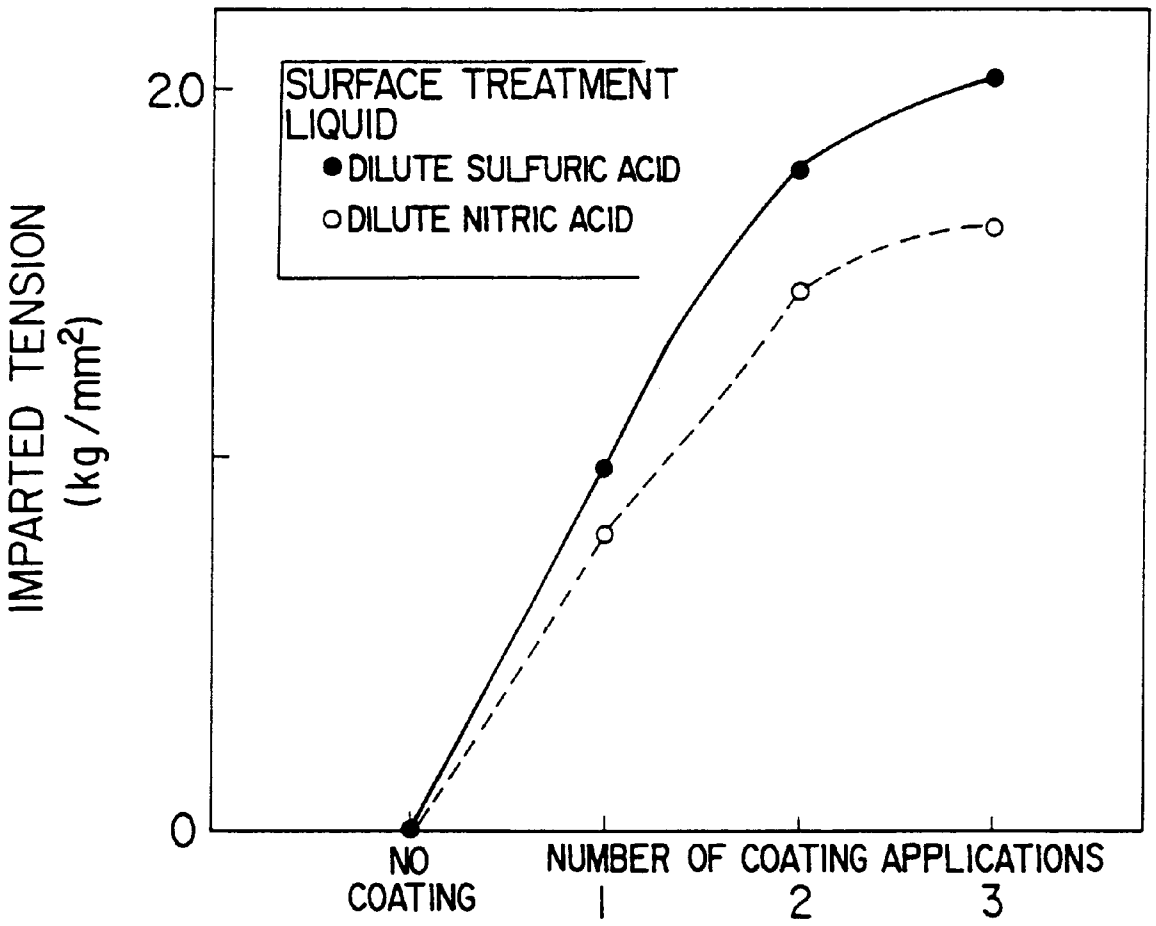
FIG. 9 is a graph showing the relationship between the number of coating applications and the tension which is given by the coating to the steel sheet.

FIG. 9 shows the relationship, established by experiments, between the number of coating applications and the tension imparted to the steel sheet by the coating. Tension values were measured from the curvature of the steel sheets in which the coating on one side surface was removed by pickling. From FIG. 9 it can be seen that the tension increases with increase in number of coating application. It can also be seen that dilute sulfuric acid treatment produced a higher degree of tension than dilute nitric acid treatment. It is considered that this is the result of the improvement in coating adhesion. It has also been confirmed that the same effect is obtained when $SiO_2$ film precipitation treatment is used in combination with the baking method using hydrogen containing atmosphere.

Figure 10:
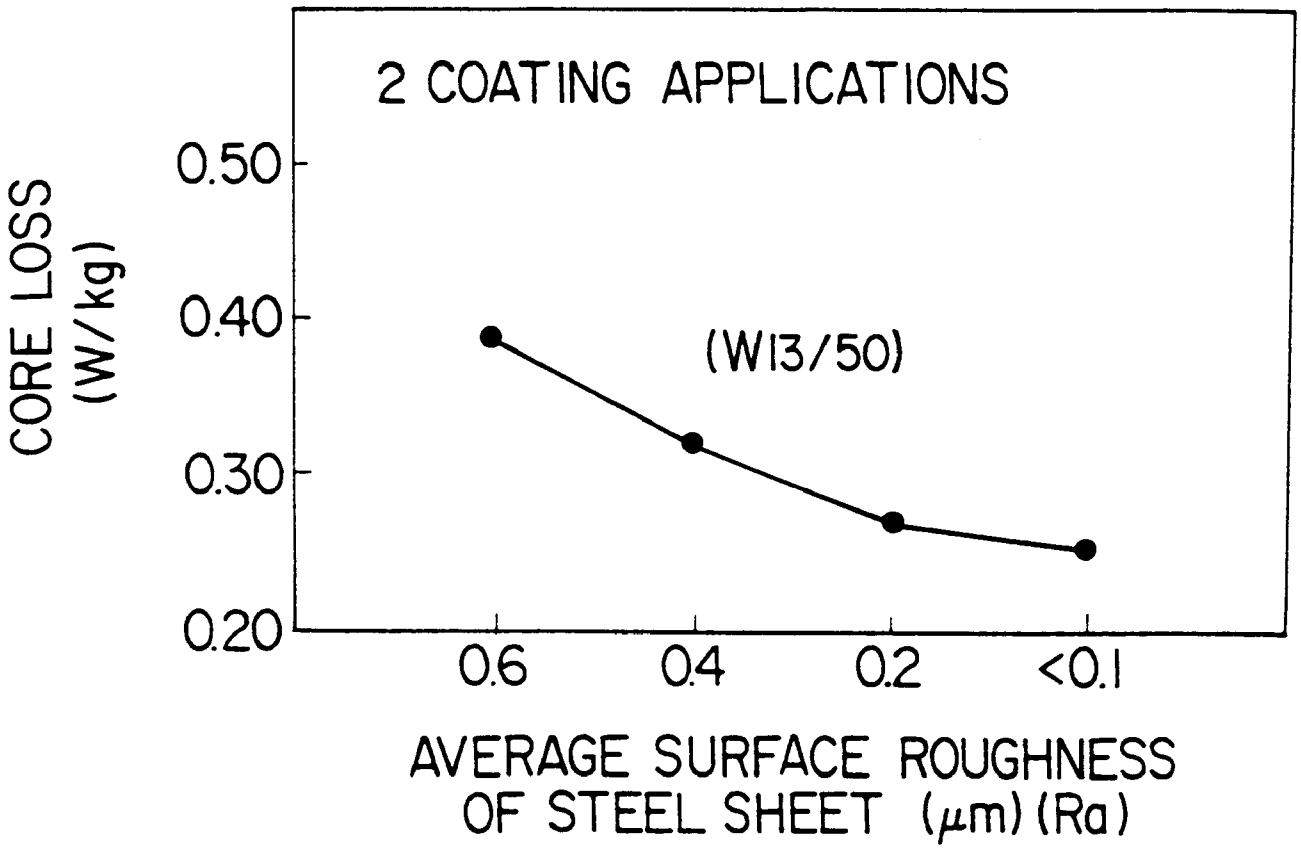
FIG. 10 is a graph showing the relationship between the average surface roughness (Ra) of the steel sheet and core loss.

Grain oriented silicon steel sheet having very low core loss values can be produced by applying the above-described insulating coating formation method to grain oriented silicon steel sheet which was mirror finished and grooved in accordance with the method described in JP-B-62-53579. According to JP-B-62-53579, the formation of grooves over 5 $\mu$m deep has a magnetic domain control effect, and if the width of the grooves exceeds 300 $\mu$m there is a decrease in the degree of improvement in core loss. The grooves are to be formed 2 to 15 mm pitch, and more preferably 3 to 8 mm pitch, and at an angle of 45 to 90 degrees, and more preferably 70 to 90 degrees, to the rolling direction. The curve of FIG. 10 was obtained with steel sheets with different surface roughness values, which were grooved by the method of JP-B-62-53579 and immersed in a dilute sulfuric acid solution to form fine pits, following which the sheets were given two times of applications and bakings of a coating liquid of chromic anhydride, colloidal silica and aluminum phosphate. The core loss values ($W_{13/50}$) at a frequency of 50 Hz and a magnetic flux density of 1.3 T were measured. It can be seen that a surface roughness of Ra<0.4 $\mu$m results in very low core loss values.

Thus, as described above, the present invention provides a method of forming a high-adhesion insulating coating on grain oriented silicon steel sheet without decreasing the tension imparted to the steel sheet. With this insulating coating formation method, therefore, it is possible to produce low core loss grain oriented silicon steel sheet due to flat interface structure between coating and base metal and high applied tension to steel sheet.

EXAMPLE 1

Silicon steel sheet containing 3 percent silicon was rolled to a final thickness of 0.23 mm and then subjected to annealing for the purpose of decarburization and also to form a surface oxide layer containing $SiO_2$, following which the steel sheet was coated with an annealing separator in which the principal component was MgO, and then subjected to final annealing. Because the surface of the grain oriented silicon steel sheet thus annealed is covered with a film in which forsterite is the main component, the steel sheet was immersed in a solution of hydrofluoric acid to remove the forsterite layer (resulting in a steel sheet thickness of 0.22 mm). Using spacers of silicon steel sheet having a glass film, the steel sheet was then subjected to an extended period of high temperature annealing in a reducing atmosphere to thereby impart a mirror finish. The steel sheet was then subjected to annealing for 70 seconds at 650° C. at a $P_{H2O}/P_{H2}$ of 0.3 to form an external oxidation layer of $SiO_2$. The thickness of the $SiO_2$ layer was then measured by infrared reflection absorption spectrometry and found to be 0.002 $\mu$m. Next, sheet was coated with 8 $g/m^2$ of a liquid consisting of 100 ml of a 20 percent colloidal silica, 60 ml of a 35 percent solution of magnesium phosphate and 5 g of chromic anhydride, which was then baked at 800° C.

A comparison sample was prepared by applying an insulating coating to steel sheet without annealing prior to baking on the insulating coating (comparison example 1). The properties of the grain oriented silicon steel sheets thus provided with an insulating coating are listed in Table 3, together with the properties of comparison examples in which the annealing step following the mirror-finishing step had been omitted.

TABLE 3

| | $SiO_2$ layer formation method | Thickness of $SiO_2$ layer ($\mu$m, per side) | Amount of insulating coating (g/m$^2$) | State of baked coating | Magnetic flux density after coating ($B_8$, T) | Core loss after coating ($W_{17/50}$, W/kg) |
|---|---|---|---|---|---|---|
| Inventive example 1 | Annealing in weak reduction atomosphere (external oxidation) | 0.002 | 8 | good | 1.93 | 0.77 |
| Comparative example 1 | None | 0 | 8 | Peeling | 1.94 | 1.15 |
| Inventive example 2 | Annealing in weak reduction atomosphere (internal oxidation) | 0.03 | 8 | good | 1.93 | 0.78 |
| Comparative example 2 | Annealing in weak reduction atomosphere (internal oxidation) | — | 8 | Peeling over whole surface | 1.94 | 1.20 |
| Inventive example 3 | Plasma CVD | 0.01 | 8 | good | 1.92 | 0.79 |
| Inventive example 4 | PVD | 0.01 | 8 | good | 1.93 | 0.77 |

EXAMPLE 2

Silicon steel sheet containing 3 percent silicon was rolled to a final thickness of 0.23 mm and then subjected to annealing for the purpose of decarburization and also to form a surface oxide layer containing $SiO_2$, following which the steel sheet was coated with an annealing separator in which the principal component was MgO, and then subjected to final annealing. Because the surface of the grain oriented silicon steel sheet thus annealed is covered with a film in which forsterite is the main component, the steel sheet was immersed in a solution of hydrofluoric acid to remove the forsterite layer, and chemical polishing was then applied to impart a mirror finish (resulting in a steel sheet thickness of 0.20 mm). The steel sheet was then subjected to annealing for 70 seconds at 800° C. at a $P_{H2O}/P_{H2}$ of 0.1 to form an external oxidation layer of $SiO_2$. The thickness of the $SiO_2$ layer was then measured by infrared reflection absorption spectrometry and found to be 0.03 $\mu$m. Next, a grooved rubber roller was used to coat the sheet with 8 g/m$^2$ of a liquid consisting of 100 ml of a 20 percent colloidal silica, 100 ml of a 50 percent solution of aluminum phosphate and 5 g of chromic anhydride, which was then baked at 800° C.

A comparison sample was prepared consisting of steel sheet in which an internal oxidation layer of $SiO_2$ was formed by annealing for 70 seconds at 800° C. at a $P_{H2O}/P_{H2}$ of 0.3 and then using the same conditions to apply and bake an insulating coating (comparison example 2). The properties of the grain oriented silicon steel sheet thus provided with an insulating coating are listed in Table 3.

EXAMPLE 3

Silicon steel sheet containing 3 percent silicon was rolled to a final thickness of 0.23 mm, subjected to decarburization annealing, coated with an annealing separator in which the principal component was $Al_2O_3$, and then subjected to final finish annealing, thereby producing grain oriented silicon steel sheet with a mirror surfaces and no film produced by annealing (resulting in a steel sheet thickness of 0.23 mm). An 0.01 $\mu$m layer of $SiO_2$ was then formed on the surface by plasma CVD, using mixed gas of $SiH_4$+$N_2O$ diluted with argon. The thickness of the $SiO_2$ layer was measured by infrared reflection absorption spectrometry. A grooved rubber roller was used to coat the sheet with 8 g/m$^2$ of a liquid consisting of 100 ml of a 20 percent colloidal silica, 100 ml of a 50 percent solution of aluminum phosphate and 5 g of chromic anhydride, which was then baked at 800° C. The properties of the grain oriented silicon steel sheet thus provided with an insulating coating are listed in Table 3.

EXAMPLE 4

Silicon steel sheet containing 3 percent silicon was rolled to a final thickness of 0.23 mm and then subjected to annealing for the purpose of decarburization and also to form a surface oxide layer containing $SiO_2$, following which the steel sheet was coated with an annealing separator in which the principal component was MgO, and then subjected to final annealing. Because the surface of the grain oriented silicon steel sheet thus annealed is covered with a film in which forsterite is the main component, the steel sheet was immersed in a solution of hydrofluoric acid to remove the forsterite layer (resulting in a steel sheet thickness of 0.22 mm). Using spacers of silicon steel sheet having glass film, the steel sheet was then subjected to an extended period of high temperature annealing in a reducing atmosphere to thereby impart a mirror finish to the surface thereof. A $SiO_2$ was then formed on the surface of the steel sheet by a PVD process in an oxygen atmosphere, using a silicon target. The thickness of the $SiO_2$ layer was then measured by infrared reflection absorption spectrometry. A grooved rubber roller was then used to coat the steel sheet with 8 g/m$^2$ of a liquid consisting of 100 ml of a 20 percent colloidal silica, 100 ml of a 50 percent solution of aluminum phosphate and 5 g of chromic anhydride, which was then baked at 800° C. The properties of the grain oriented silicon steel sheet thus provided with an insulating coating are listed in Table 3.

EXAMPLE 5

Silicon steel sheet containing 3 percent silicon was rolled to a final thickness of 0.23 mm and then subjected to annealing for the purpose of decarburization and also to form a surface oxide layer containing $SiO_2$, following which the steel sheet was coated with an annealing separator in which the principal component was MgO, and then subjected to final annealing. Because the surface of the grain oriented silicon steel sheet thus annealed is covered with a film in which forsterite is the main component, the steel sheet was immersed in a solution of hydrofluoric acid to remove the forsterite layer (resulting in a steel sheet thickness of 0.22 mm).

A grooved rubber roller was then used to coat the steel sheet with 9 g/m$^2$ of a liquid consisting of 100 ml of a 20 percent colloidal silica, 100 ml of a 50 percent solution of aluminum phosphate and 5 g of chromic anhydride. The coating was then baked at 850° C. in an atmosphere of 20 percent hydrogen and 80 percent nitrogen. A comparison sample was given a coating that was baked in a 100 percent nitrogen atmosphere. The properties of the grain oriented silicon steel sheet thus provided with an insulating coating are listed in Table 4, from which it can be seen that the coating baked in an atmosphere that contained hydrogen had superior adhesion, and applied a high tension of 1.0 kg/mm$^2$ to the steel sheet, and core loss properties were also good.

TABLE 4

| | Hydrogen content of baking atmosphere (%) | Amount of coating remaining after bending test using 20 mm-diameter bar (%) | Tension (kg/mm$^2$) | Core loss ($W_{17/50}$) (W/kg) |
|---|---|---|---|---|
| Comparative example | 0 | 5 | 0.1 | 0.95 |
| Inventive example | 15 | 100 | 1.0 | 0.74 |

EXAMPLE 6

Silicon steel sheet containing 3 percent silicon was rolled to a final thickness of 0.23 mm and then subjected to annealing for the purpose of decarburization and also to form a surface oxide layer containing $SiO_2$, following which the steel sheet was coated with an annealing separator in which the principal component was MgO, and then subjected to final annealing. Because the surface of the grain oriented silicon steel sheet thus annealed is covered with a film in which forsterite is the main component, the steel sheet was immersed in a solution of hydrofluoric acid to remove the forsterite layer (resulting in a steel sheet thickness of 0.20 mm).

A grooved rubber roller was then used to coat the steel sheet with 9 g/m$^2$ of a liquid consisting of 100 ml of a 20 percent colloidal silica, 60 ml of a 35 percent solution of magnesium phosphate and 5 g of chromic anhydride. The coating was then baked at 850° C. in an atmosphere of 20 percent hydrogen and 80 percent nitrogen. A comparison sample was given a coating that was baked in a 100 percent nitrogen atmosphere. The properties of the grain oriented silicon steel sheet thus provided with an insulating coating are listed in Table 5, from which it can be seen that the coating baked in an atmosphere that contained hydrogen had superior adhesion and applied a high tension of 1.0 kg/mm$^2$ to the steel sheet, and core loss properties were also good.

TABLE 5

| | Hydrogen content of baking atmosphere (%) | Amount of coating remaining after bending test using 20 mm-diameter bar (%) | Tension (kg/mm$^2$) | Core loss ($W_{17/50}$) (W/kg) |
|---|---|---|---|---|
| Comparative example | 0 | 5 | 0 | 0.89 |
| Inventive example | 20 | 95 | 1.0 | 0.70 |

EXAMPLE 7

Silicon steel sheet containing 3 percent silicon was rolled to a final thickness of 0.23 mm and then subjected to annealing for the purpose of decarburization and also to form a surface oxide layer containing $SiO_2$, following which the steel sheet was coated with an annealing separator in which the principal component was MgO, and then subjected to final annealing. Because the surface of the grain oriented silicon steel sheet thus annealed is covered with a film in which forsterite is the main component, the steel sheet was immersed in a solution of hydrofluoric acid to remove the forsterite layer and the sheet surface was then flattened by annealing it in a dry hydrogen atmosphere at 1200° C. for 20 hours (resulting in a steel sheet thickness of 0.21 mm).

A grooved rubber roller was then used to coat the steel sheet with 9 g/m$^2$ of a liquid consisting of 100 ml of a 20 percent colloidal silica, 100 ml of a 50 percent solution of aluminum phosphate and 5 g of chromic anhydride. The coating was then baked at 850° C. in an atmosphere of 20 percent hydrogen and 80 percent nitrogen. A comparison sample was given a coating that was baked in a 100 percent nitrogen atmosphere. The properties of the grain oriented silicon steel sheet thus provided with an insulating coating are listed in Table 6. It can be seen that the coating baked in an atmosphere that contained hydrogen had superior adhesion, and applied a high tension of 1.1 kg/mm$^2$ to the steel sheet, and core loss properties were also good.

TABLE 6

| | Hydrogen content of baking atmosphere (%) | Amount of coating remaining after bending test using 20 mm-diameter bar (%) | Tension (kg/mm$^2$) | Core loss ($W_{17/50}$) (W/kg) |
|---|---|---|---|---|
| Comparative example | 0 | 5 | 0.1 | 0.90 |
| Inventive example | 5 | 100 | 1.1 | 0.71 |

EXAMPLE 8

Silicon steel sheet containing 3 percent silicon was rolled to a final thickness of 0.145 mm, subjected to decarburization annealing, coated with an annealing separator in which the principal component was $Al_2O_3$, and then subjected to final annealing, thereby producing grain oriented silicon steel sheet having a mirror surface finish and no film produced by annealing (0.145 mm thick).

A grooved rubber roller was then used to coat the steel sheet with 9 g/m$^2$ of a liquid consisting of 100 ml of a 30 percent colloidal silica, 60 ml of a 35 percent solution of magnesium phosphate and 5 g of chromic anhydride. The coating was then baked at 850° C. in an atmosphere of 20 percent hydrogen and 80 percent nitrogen. A comparison sample was given a coating that was baked in a 100 percent nitrogen atmosphere. The properties of the grain oriented silicon steel sheet thus provided with an insulating coating are listed in Table 7. The coating baked in an atmosphere that contained hydrogen had superior adhesion and applied a high tension of 1.5 kg/mm$^2$ to the steel sheet, and core loss properties were also good.

TABLE 7

| | Hydrogen content of baking atmosphere (%) | Amount of coating remaining after bending test using 20 mm-diameter bar (%) | Tension (kg/mm$^2$) | Core loss ($W_{17/50}$) (W/kg) |
|---|---|---|---|---|
| Comparative example | 0 | 5 | 0.1 | 0.88 |
| Inventive example | 15 | 100 | 1.5 | 0.63 |

EXAMPLE 9

Linear grooves 15 $\mu$m deep and 50 $\mu$m wide, and arranged 5 mm pitch and an angle of 75 degrees relative to the rolling direction, were formed on grain oriented silicon steel sheets having a thickness of 0.17 mm and a magnetic flux density of $B_8$:1.94 T at 8000 A/m, and the steel sheets were then annealed for 2 hours at 850° C. Pickling was then used to remove the glass film and chemical polishing was applied to form a mirror finish with an average surface roughness less than 0.1 $\mu$m. This processing reduced the sheet thickness to 0.16 mm.

Some of the sheets were then immersed for 60 seconds in a 5 percent solution of sulfuric acid or a 10 percent nickel sulfate solution, then washed and dried. The steel sheets was then coated with a liquid in which the main components were chromic anhydride, aluminum phosphate and a colloidal silica, or with a liquid in which the main components were chromic anhydride, magnesium phosphate and a colloidal silica. The coating was then baked for 30 seconds at 850° C. The magnetic properties of the grain oriented silicon steel sheet thus processed are listed in Table 8. Steel sheet treated with sulfuric acid or nickel sulfate before applying the coating liquid showed improved coating liquid wettability and adhesion, and good core loss properties.

TABLE 8

| | | | Pretreatment liquid | | |
|---|---|---|---|---|---|
| Coating liquid | | | None (as chemical polishing) | Dilute sulfuric acid solution | Nickel sulfuric solution |
| Chromic anhydride + aluminum phosphate + colloidal silica | $B_8$ | (T) | 1.91 | 1.91 | 1.91 |
| | $W_{13/50}$ | (W/kg) | 0.31 | 0.27 | 0.28 |
| Chromic anhydride + magnesium phosphate + colloidal silica | $B_8$ | (T) | 1.91 | 1.91 | 1.91 |
| | $W_{13/50}$ | (W/kg) | 0.31 | 0.28 | 0.29 |

EXAMPLE 10

Linear grooves 12 $\mu$m deep and 50 $\mu$m wide, and arranged 5 mm pitch and an the angle of 75 degrees relative to the rolling direction, were formed on grain oriented silicon steel sheets having a thickness of 0.15 mm and a magnetic flux density of $B_8$:1.95 T at 8000 A/m, and the steel sheets were then annealed for 2 hours at 850° C. The sheets were then pickled to remove the glass film and chemical polishing was applied to form a mirror finish with an average surface roughness less than 0.1 $\mu$m. This processing reduced the sheet thickness to 0.135 mm.

Some of the sheet samples were then annealed in a weak oxidazation atmosphere to form an external oxidation layer of $SiO_2$ with a thickness of 0.02 $\mu$m, and some of the samples were immersed for 60 seconds in a 5 percent solution of sulfuric acid, then dried. Each sample was then coated with a liquid in which the main components were chromic anhydride, aluminum phosphate and a colloidal silica, and then baked for 30 seconds at 840° C. in an atmosphere of pure nitrogen or in a nitrogen atmosphere containing 15 percent hydrogen. The magnetic properties of the steel sheet thus obtained were measured, and further coating was applied using the same conditions. The results are listed in Table 9. The use of pretreatments and the introduction of hydrogen into the baking atmosphere enable to form thick insulating coating with good adhesion, and to produce grain oriented silicon steel sheet with very low core loss.

TABLE 9

| Pretreatment | Baking atmosphere | Number of coatings | $B_8$ (T) | $W_{13/50}$ (W/kg) |
|---|---|---|---|---|
| $SiO_2$ film formation | $N_2$ | 1 | 1.92 | 0.27 |
| | | 2 | 1.91 | 0.22 |
| | | 3 | Peeling of coating | |
| | $N_2 + H_2$ | 1 | 1.92 | 0.27 |
| | | 2 | 1.91 | 0.22 |
| | | 3 | 1.90 | 0.20 |
| Pickling in dilute sulfuric acid | $N_2$ | 1 | 1.92 | 0.27 |
| | | 2 | 1.91 | 0.22 |
| | | 3 | Peeling of coating | |
| | $N_2 + H_2$ | 1 | 1.92 | 0.27 |
| | | 2 | 1.91 | 0.22 |
| | | 3 | 1.90 | 0.20 |

What is claimed is:

1. A method of forming an insulating coating on a grain oriented silicon steel sheet comprising:

providing a final annealed grain oriented silicon steel sheet having a silicon content of from 2 to 4.8 percent by weight and which does not have an inorganic mineral surface layer on a surface thereof;

forming an external oxidation $SiO_2$ layer having a film structure and having a layer thickness of not less than 0.001 $\mu$m on said surface of said final annealed grain oriented silicon steel sheet not having the inorganic mineral surface layer thereon by subjecting said final annealed grain oriented silicon steel sheet to soaking at a temperature of 500 to 700° C. in a controlled weakly oxidizing atmosphere wherein $P_{H20}/P_{H2} \leqq 0.5$, wherein $P_{H20}$ is water vapor partial pressure in the atmosphere and $P_{H2}$ is hydrogen partial pressure in the atmosphere, said external oxidation $SiO_2$ layer resulting from silicon in the steel sheet diffusing to the surface of the steel sheet not having the inorganic mineral surface layer and oxidizing on said surface to form said external oxidation $SiO_2$ layer;

forming a tension-imparting insulating coating on said external oxidation $SiO_2$ layer on said surface of said final annealed grain-oriented silicon steel sheet not having the inorganic mineral surface layer thereon.

2. A method of forming an insulating coating on a grain oriented silicon steel sheet comprising:

providing a final annealed grain oriented silicon steel sheet having a silicon content of from 2 to 4.8 percent by weight and which does not have an inorganic mineral surface layer on a surface thereof;

forming an external oxidation $SiO_2$ layer having a film structure and having a layer thickness of not less than 0.001 $\mu$m on said surface of said final annealed grain oriented silicon steel sheet not having the inorganic mineral surface layer thereon by subjecting said final annealed grain oriented silicon steel sheet to soaking at a temperature of 700 to 1000° C. in a controlled weakly oxidizing atmosphere wherein $P_{H2O}/P_{H2} \leqq 0.15$, wherein $P_{H2O}$ is water vapor partial pressure in the atmosphere and $P_{H2}$ is hydrogen partial pressure in the atmosphere, said external oxidation $SiO_2$ layer resulting from silicon in the steel sheet diffusing to the surface of the steel sheet not having the inorganic mineral surface layer and oxidizing on said surface to form said external oxidation $SiO_2$ layer;

forming a tension-imparting insulating coating on said external oxidation $SiO_2$ layer on said surface of said final annealed grain-oriented silicon steel sheet not having an inorganic mineral surface layer thereon.

3. A method of forming an insulating coating on a grain oriented silicon sheet according to claim 1 wherein said step of forming said tension-imparting insulating coasting comprises a process of applying and baking a coating material two or more times.

4. A method of forming an insulating coating on a grain oriented silicon steel sheet according to claim 2 wherein said step of forming said tension-imparting insulating coating comprises a process of applying and baking a coating material two or more times.

5. A method of forming an insulating coating on a grain oriented silicon steel sheet according to claim 1 wherein said step of forming said tension-imparting insulating coating comprises applying a coating liquid having as a main component at least one compound selected from the group consisting of chromic anhydride, colloidal silica and phosphate.

6. A method of forming an insulating coating on a grain oriented silicon steel sheet according to claim 2 wherein said step of forming said tension-imparting insulating coating comprises applying a coating liquid having as a main component at least one compound selected from the group consisting of chromic anhydride, colloidal silica and phosphate.

7. A method of forming an insulating coating on a grain oriented silicon steel sheet comprising:

providing a final annealed grain oriented silicon steel sheet having a silicon content of from 2 to 4.8 percent by weight and which does not have an inorganic mineral surface layer on a surface thereof;

immersing said final annealed grain oriented silicon steel sheet which does not have said inorganic mineral surface layer on said surface thereof for 10 to 180 seconds in a sulfuric acid or sulfate solution having a concentration of sulfuric acid brought within 2 to 30 percent; and then washing and drying said final annealed grain oriented silicon steel sheet; and then forming a tension-imparting coating on said surface of said final annealed grain oriented silicon steel sheet not having said inorganic surface layer.

8. A method of forming an insulating coating on a grain oriented silicon steel sheet according to claim 7 further comprises baking said tension-imparting coating in an atmosphere containing hydrogen.

9. A method of forming an insulating coating on a grain oriented silicon steel sheet according to claim 7 wherein said step of forming said tension-imparting insulating coating comprises a process of applying and baking a coating material two or more times.

10. A method of forming an insulating coating on a grain oriented silicon steel sheet according to claim 7 wherein said step of forming said tension-imparting insulating coating comprises applying a coating liquid having as a main component at least one compound selected from the group consisting of chromic anhydride, colloidal silica and phosphate.

* * * * *